US007681743B2

(12) United States Patent
Hanretty et al.

(10) Patent No.: US 7,681,743 B2
(45) Date of Patent: Mar. 23, 2010

(54) BEVERAGE CONTAINER SHELF MANAGEMENT SYSTEM

(75) Inventors: Peter Hanretty, Port Chester, NY (US); Shao Hua Li, Dongguan (CN)

(73) Assignee: Source 1 Displays, a division of Fortune Resources, Bergenfield, NJ (US)

( * ) Notice: Subject to any disclaimer, the term of this patent is extended or adjusted under 35 U.S.C. 154(b) by 914 days.

(21) Appl. No.: 11/374,869

(22) Filed: Mar. 14, 2006

(65) Prior Publication Data

US 2007/0119799 A1 May 31, 2007

Related U.S. Application Data

(63) Continuation-in-part of application No. 11/288,637, filed on Nov. 29, 2005.

(51) Int. Cl.
*A47F 1/04* (2006.01)

(52) U.S. Cl. ..... 211/59.2; 211/74

(58) Field of Classification Search ..... 211/59.2, 211/59.3, 43, 184, 74; 312/35, 61, 71, 72, 312/42, 45

See application file for complete search history.

(56) References Cited

U.S. PATENT DOCUMENTS 4,474,297 A * 10/1984 Zucker ..... 211/59.2
5,022,535 A * 6/1991 Spamer ..... 211/59.2
5,450,968 A * 9/1995 Bustos ..... 211/59.2
5,645,176 A * 7/1997 Jay ..... 211/59.2
5,884,782 A * 3/1999 Dembicks ..... 211/70.6
6,082,557 A * 7/2000 Leahy ..... 211/59.3
6,332,547 B1 * 12/2001 Shaw et al. ..... 211/59.2
6,360,901 B1 * 3/2002 Parham ..... 211/59.2
6,490,983 B1 * 12/2002 Nicholson et al. ..... 108/106
6,497,326 B1 * 12/2002 Osawa ..... 211/59.2
6,533,131 B2 * 3/2003 Bada ..... 211/59.2
6,615,995 B2 * 9/2003 Primiano et al. ..... 211/59.2
6,820,754 B2 * 11/2004 Ondrasik ..... 211/59.3
7,063,217 B2 * 6/2006 Burke ..... 211/59.3
7,207,447 B2 * 4/2007 Medcalf et al. ..... 211/59.2
2002/0108916 A1 * 8/2002 Nickerson ..... 211/59.3
2002/0170866 A1 * 11/2002 Johnson et al. ..... 211/59.3
2005/0092703 A1 * 5/2005 Mueller et al. ..... 211/59.3
2005/0150847 A1 * 7/2005 Hawkinson ..... 211/59.2
2006/0278591 A1 * 12/2006 Tippets et al. ..... 211/59.2
2007/0068885 A1 * 3/2007 Busto et al. ..... 211/59.3
2007/0278171 A1 * 12/2007 Jersey et al. ..... 211/188

* cited by examiner

*Primary Examiner*—Jennifer E. Novosad
(74) *Attorney, Agent, or Firm*—R. Blake Johnston; DLA Piper US LLP

(57) ABSTRACT

A gravity feed display rack for supporting and displaying merchandise is provided. The rack has a merchandise channel support structure featuring a number of rods. Inner and outer dividers featuring merchandise supports and longitudinally extending walls are positioned on the rods in a sliding fashion. End portions of the rods feature adjustable latch slots and at least one outer divider features connectors with locking projections that engage the adjustable latch slots of the merchandise channel support structure. As a result, the dividers are located in spaced apart relationship upon the merchandise channel support structure and may be adjusted to accommodate varying sizes of merchandise.

5 Claims, 13 Drawing Sheets

BEVERAGE CONTAINER SHELF MANAGEMENT SYSTEM

REFERENCE TO RELATED APPLICATIONS

This application is a continuation-in-part of U.S. patent application Ser. No. 11/288,637, filed Nov. 29, 2005, currently pending.

FIELD OF THE INVENTION

The invention relates, generally, to bottle and can shelving systems and, in particular, to a user configurable shelving system for gravity-feed beverage containers.

BACKGROUND OF THE INVENTION

The prior art includes systems for displaying chilled beverage containers for ready access to retail customers. One system is shown in U.S. Pat. No. 4,785,945, which issued to Rowse, et al., and which is incorporated herein by reference. The prior art further includes U.S. Pat. No. 5,645,176 which issued to Jay, and U.S. Pat. No. 6,389,993 which issued to Ondrasik.

SUMMARY OF THE INVENTION

It is an object of the present invention to provide a shelving system which may be configured by the retail business which displays and sells the containers or beverages.

It is an object of the present invention to provide a bottle or container shelving system which may be reconfigured from the original arrangement.

It is a further object of the present invention to provide a container shelving system which may be configured to accommodate a variety of container sizes, and reconfigured thereafter as desired.

The present invention is a gravity feed display rack for supporting and displaying merchandise that includes a merchandise channel support structure including a rod. The rod has an adjustable latch slot formed therein. An inner divider is slidably mounted on the rod of the merchandise channel support structure. The inner divider includes a merchandise support and a longitudinally extending wall. An outer divider includes a merchandise support, a longitudinally extending wall and a connector. The connector is sized to receive the rod of the merchandise channel support structure. The connector has a locking projector sized to engage the adjustable latch slot of the rod so that the outer divider may be secured in a desired position on the rod of the merchandise channel support structure.

The adjustable latch slot is formed in an end portion of the rod of the merchandise channel support structure. In addition, the adjustable latch slot features a plurality of teeth where the teeth define adjacent, semi-triangular openings in the adjustable latch slot. The locking projection is formed on a finger of the connector and is generally triangular shaped so as to selectively engage the semi-triangular openings of the adjustable latch slot.

The following detailed description of embodiments of the invention, taken in conjunction with the appended claims and accompanying drawings, provide a more complete understanding of the nature and scope of the invention.

DETAILED DESCRIPTION OF THE INVENTION

Figure 1:
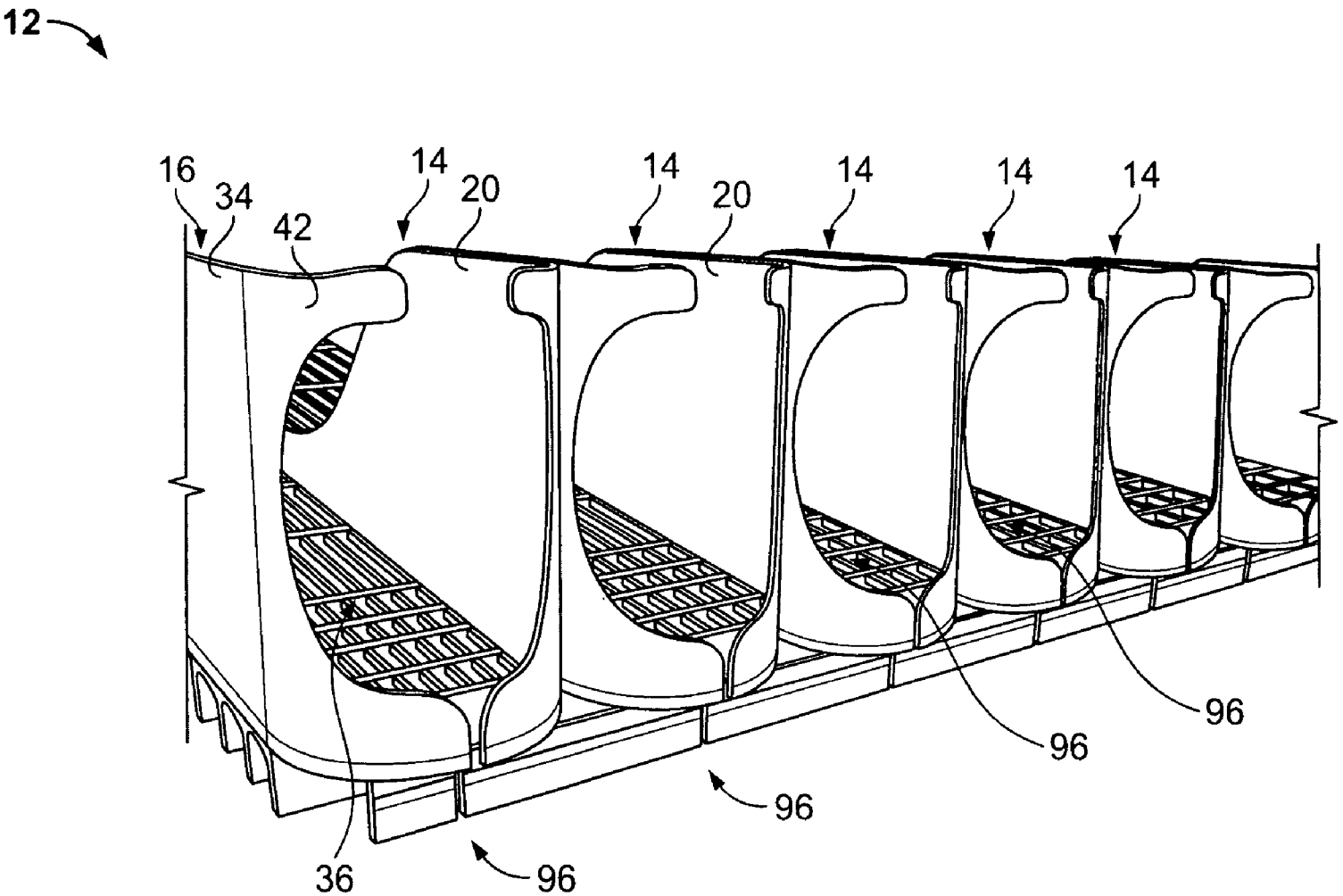
FIG. 1 is a perspective view of the shelf management system in accordance with the present invention.
Figure 2:
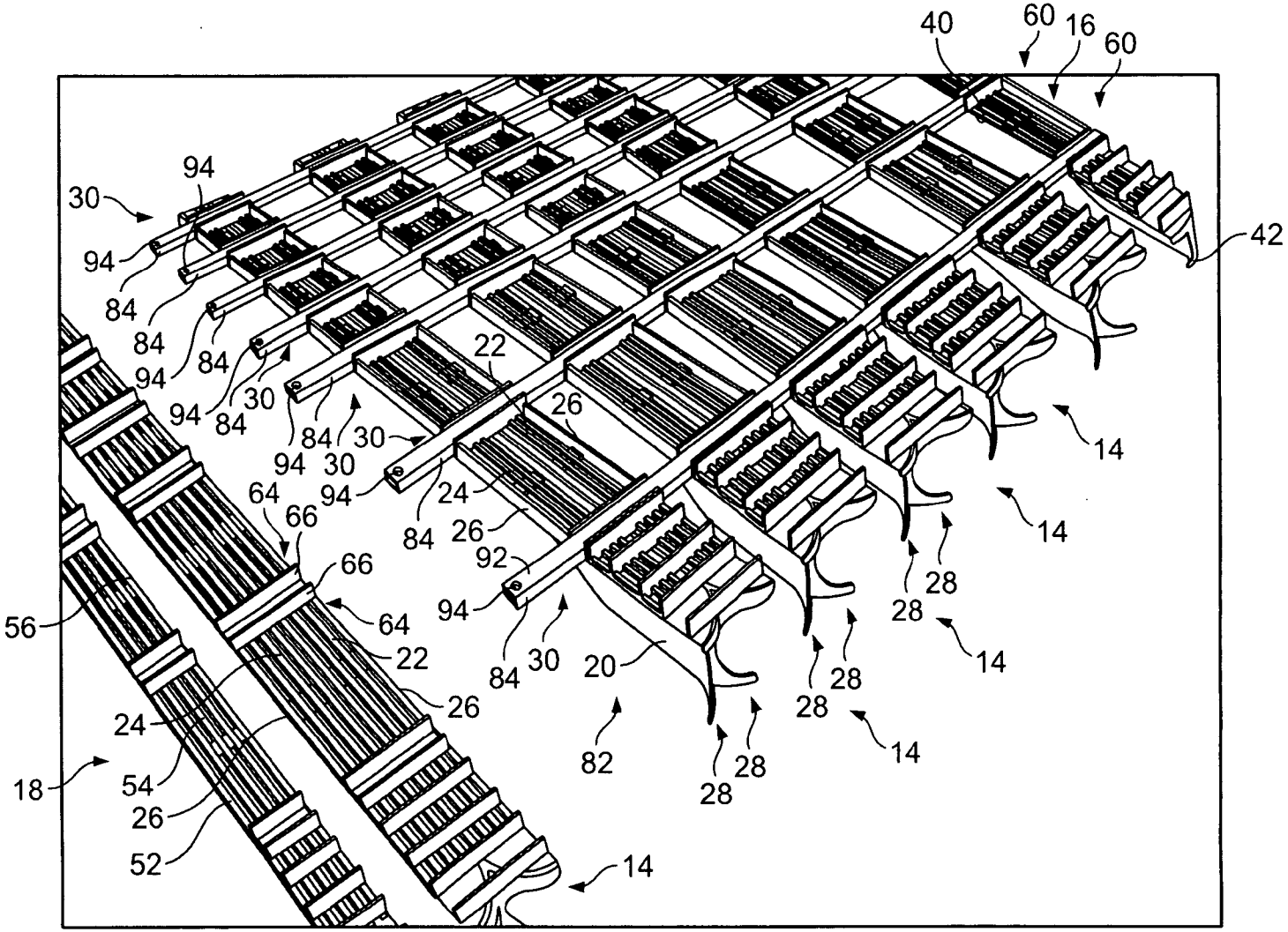
FIG. 2 is a partial exploded bottom perspective view of the shelf management system in accordance with the present invention, showing the left and right outer dividers, and a plurality of inner dividers, and a plurality of rods.

FIG. 1 is a perspective view of the shelf management system in accordance with the present invention. A gravity feed display rack 12 is shown. FIG. 2 is a bottom view of the rack 12, shown partially disassembled. The rack 12 includes a plurality of inner dividers 14, a right outer divider 16 and a left outer divider 18 (see FIG. 2). The inner dividers 14 include a longitudinally extending wall 20, with a right and left merchandise support 22, 24 extending in opposite directions from the wall 20. The merchandise supports 22, 24 each having a longitudinally extending edge 26 (see FIG. 2). The wall 20 splits into two diverging curved front walls 28. The inner dividers 14 include a plurality of connectors 30 (see FIG. 2).

The right outer divider 16 includes a longitudinally extending wall 34, with a right merchandise support 36 extending from the wall 34. The merchandise support 36 having a longitudinally extending edge 40. The wall 34 merges into a curved front wall 42. The right divider 32 includes a plurality of connectors 60 (see also FIGS. 6A and 6B).

Figure 7:
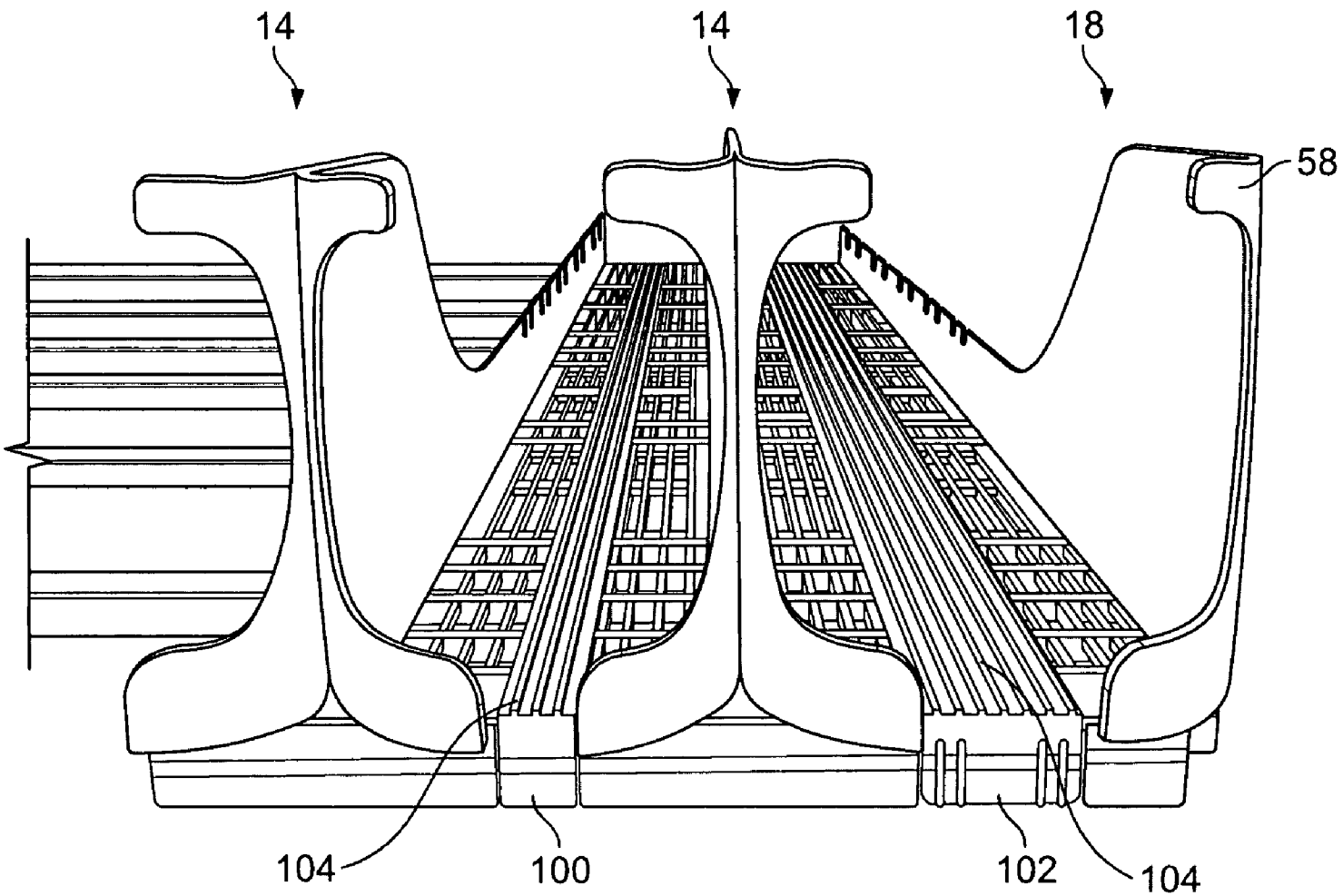
FIG. 7 is a partial front view of the shelf management system showing a narrow spacer and a wide spacer, in accordance with the present invention.

FIG. 2 shows the left outer divider 18. The left divider 18 includes a longitudinally extending wall 52, with a left merchandise support 54 extending from the wall 52. The merchandise support 54 having a longitudinally extending edge 56. The wall 52 merges into a curved front wall 58 (FIG. 7).

Additional details of the left outer divider 18 are presented below with reference to FIGS. 9-16B.

Figure 5:
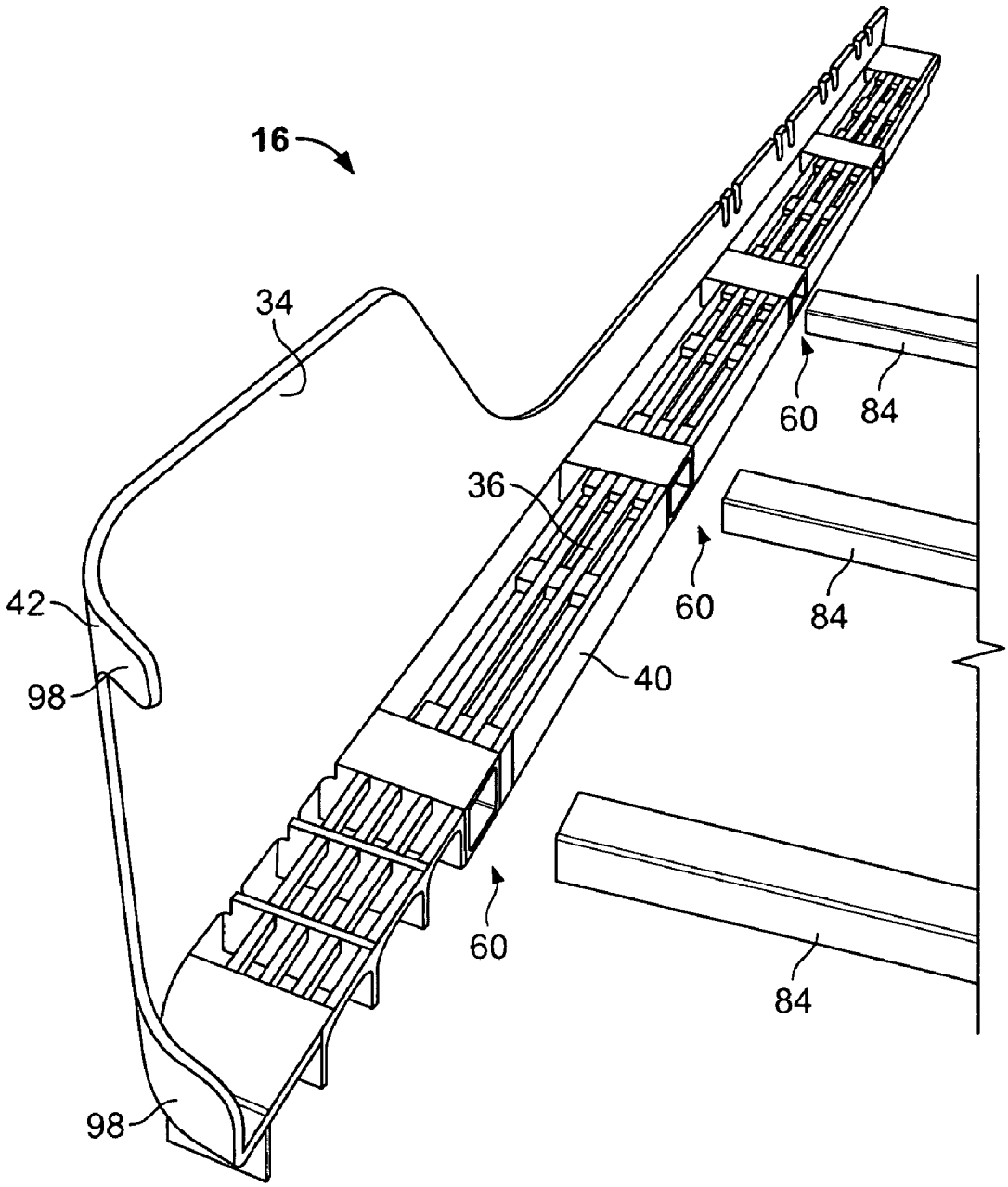
FIG. 5 is a perspective view of the right outer divider and a portion of a plurality of rods, in accordance with the present invention.
Figure 6A:
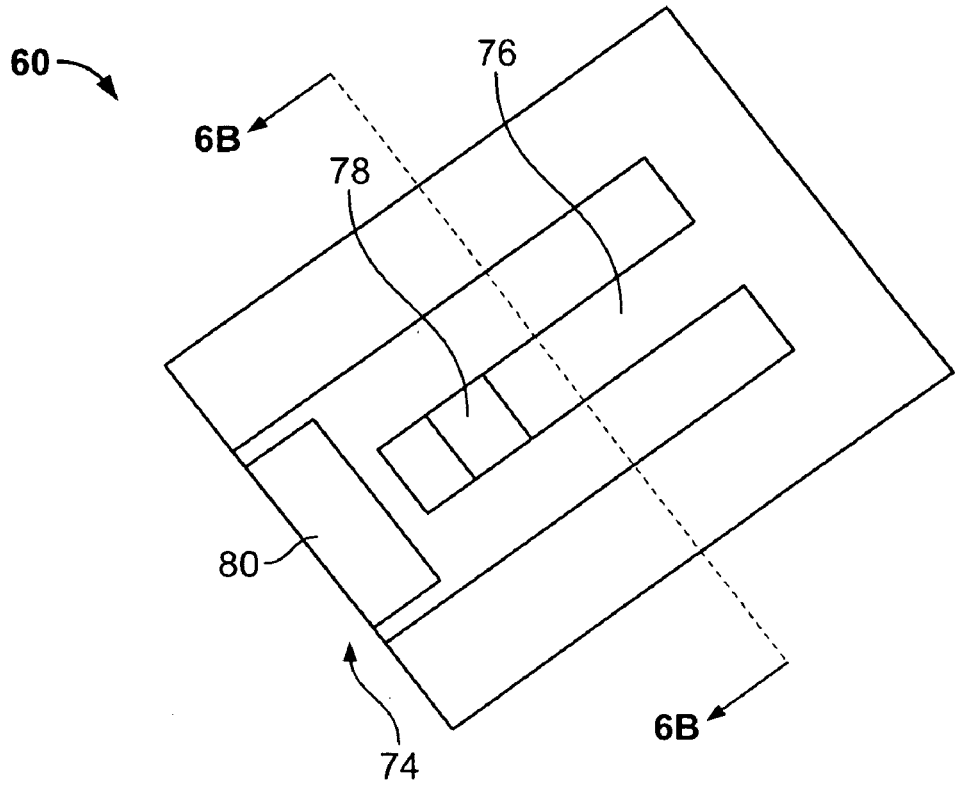
FIG. 6A is an enlarged view of the connector of the right outer divider of FIG. 2.
Figure 6B:
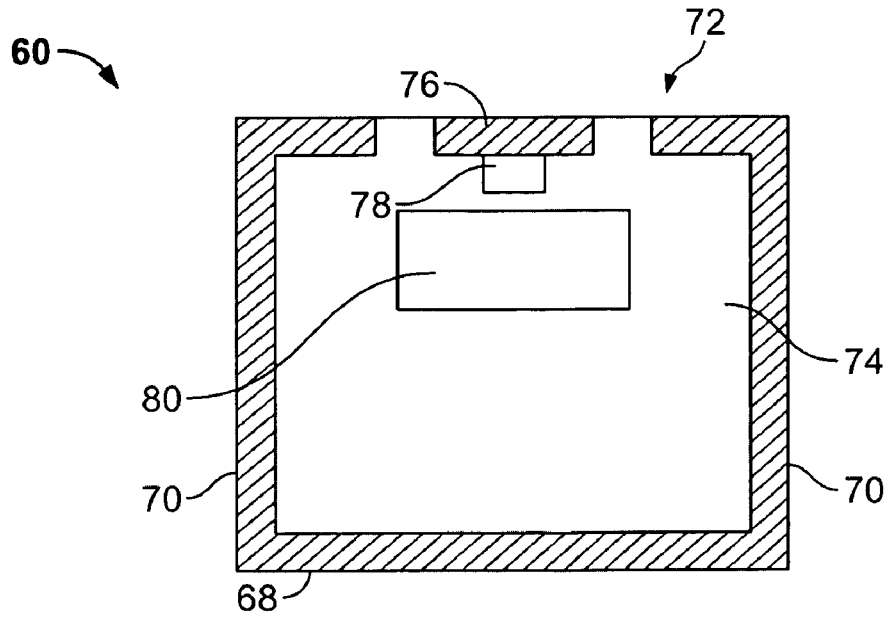
FIG. 6B is a sectional view of the connector of FIG. 6A taken along line 6B-6B.

FIG. 2 shows the connectors, 30 and 60. Each connector 30 is shown to include two depending spaced apart facing connector walls 64 depending downwardly (as viewed from FIG. 1) from the merchandise support. The connector walls each include a flange 66. FIGS. 5, 6A and 6B show that the connectors 60 include a top wall 68, opposing sidewalls 70, a bottom wall 72, and an end wall 74. FIGS. 6A and 6B show the bottom wall 72 of connector 60 to include a finger 76, having a locking detent 78. The end wall 74 includes an abutment 80.

FIG. 2 also shows the merchandise channel support structure 82. The merchandise channel support structure 82 includes a plurality of rods 84. The rods 84 include four walls 86, 88, 90 and 92 (see FIG. 4). The bottom wall 92, as viewed in FIG. 1, includes a latch opening 94 (See FIG. 2) at the right end of each rod 84.

As demonstrated in FIG. 1, pairs of dividers 14, 16 and 18 form respective split merchandise channels 96.

Figure 3:
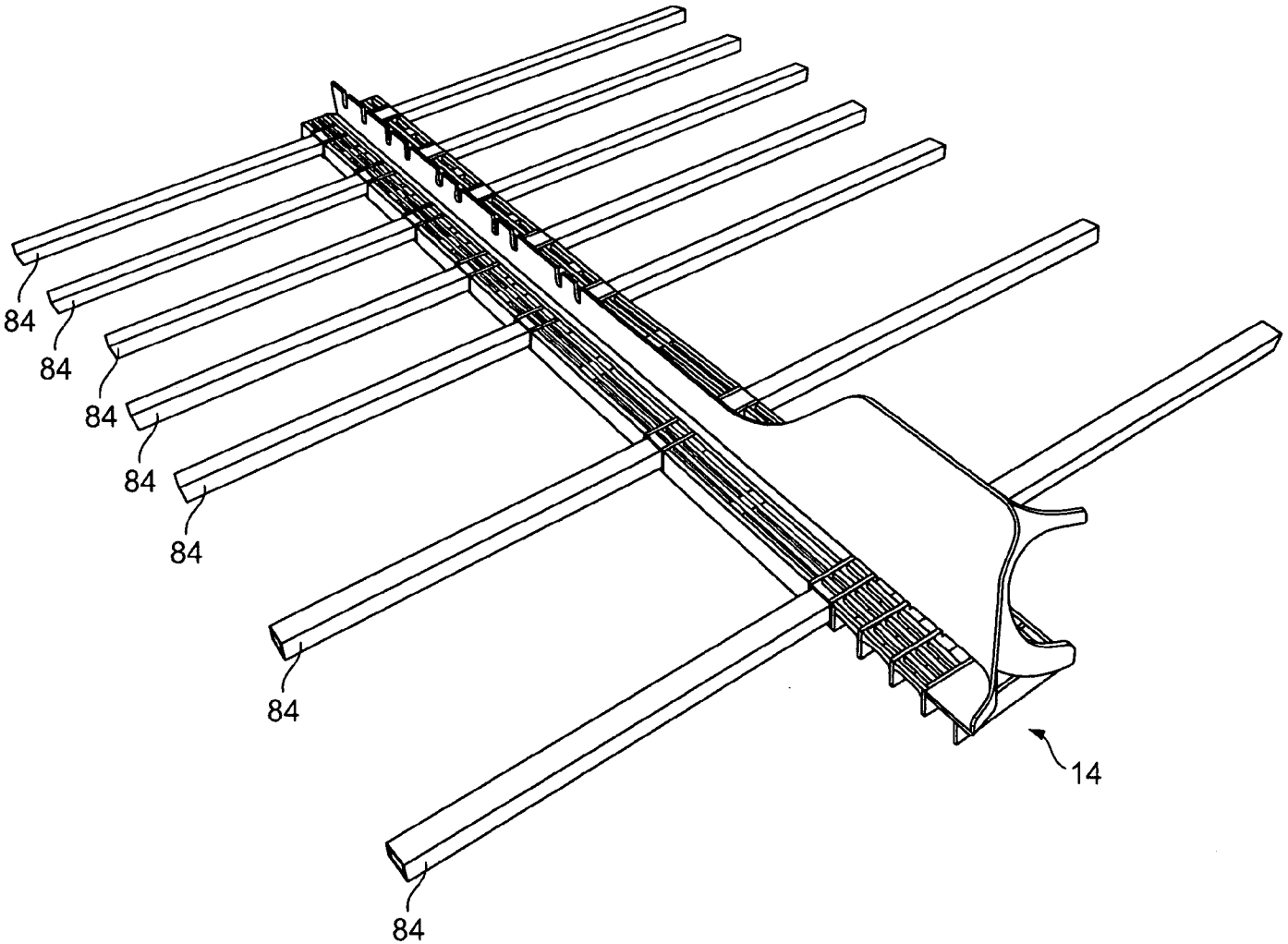
FIG. 3 is a perspective view of an inner divider and a plurality of rods.

FIGS. 2 and 3 show the plurality of rods 84, each rod shown having an opening 94 to receive a detent 78 of the locking flange 76 for securing the rod in place with respect to the left outer divider at one side, and the right outer divider at the other side. The plurality of rods will extend through the respective openings or connectors of the inner, left outer and right outer dividers.

Figure 4:
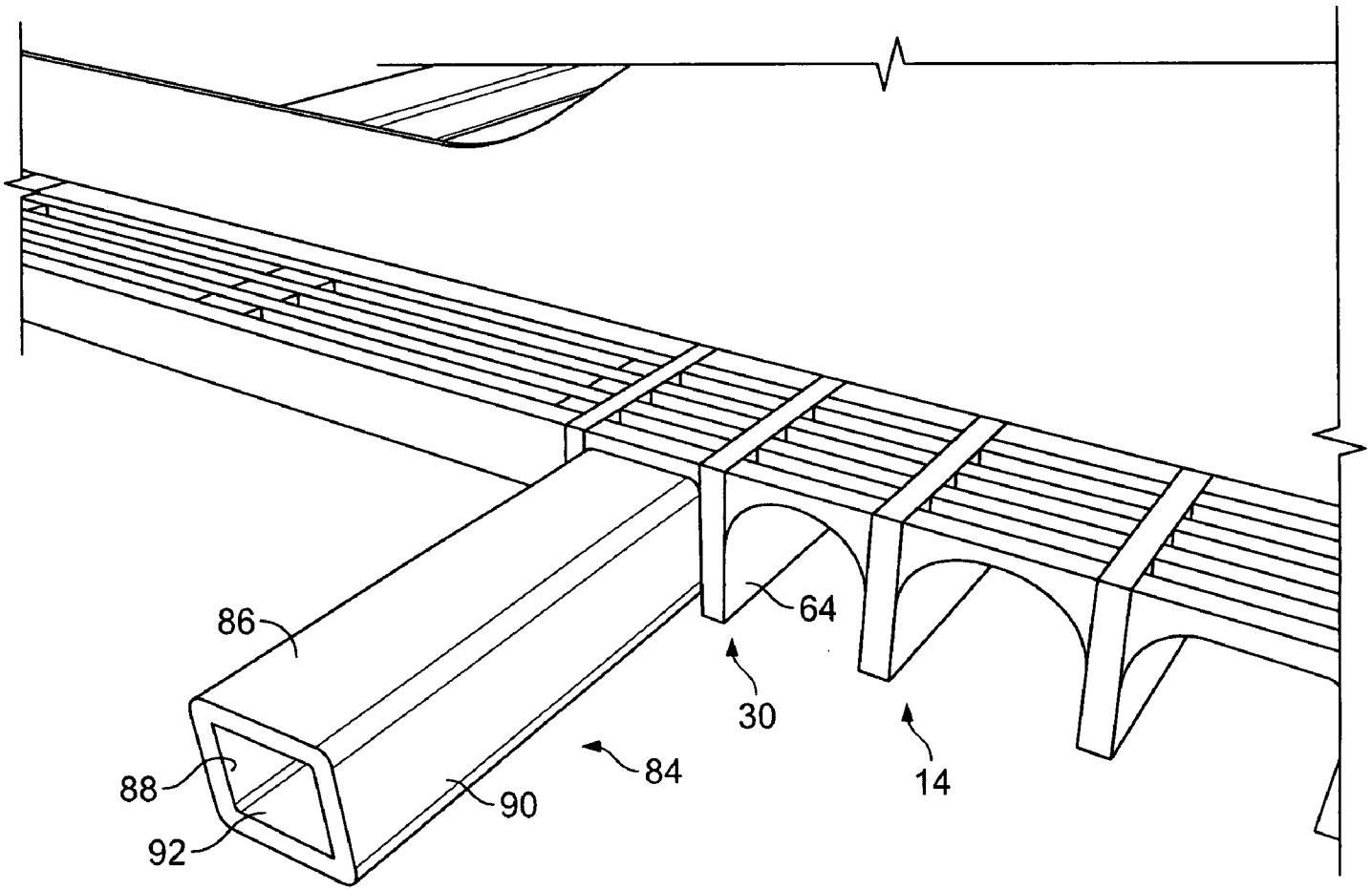
FIG. 4 is an enlarged view of FIG. 3, with a rod extending through the rod passage of the inner divider.

FIG. 4 shows a enlarged view of one inner divider 14 with a rod 84 extending through the opening or connector 30. The connector can be seen to be formed by a horizontal surface and two opposed parallel facing vertical surfaces or connector walls 64 having a flange 66 at the end for retaining the rod within the connector 30. The rod extends within the connector 30 but not in an interference fit. Rather, the rod is slidable within the connector 30.

FIG. 5 shows a right outer divider 16 having a right or longitudinally extending outer wall 34 which extends in a forward direction and curves to provide the curved front wall 42 with lower and upper stops 98. The divider further provides a horizontal surface or merchandise support 36 and a plurality of openings or connectors 60.

Figure 8:
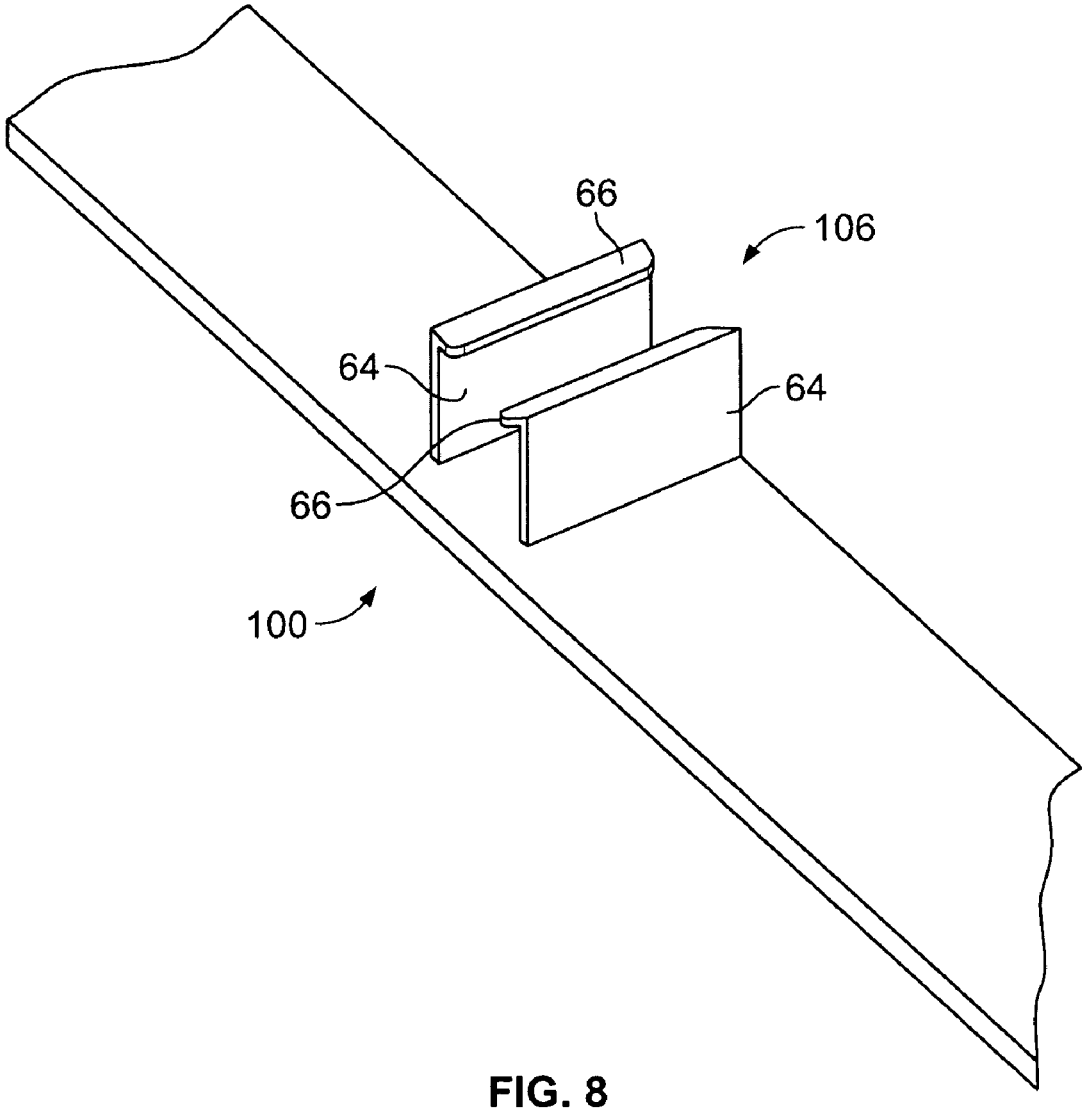
FIG. 8 is a bottom view of a narrow spacer, in accordance with the present invention.

It will be appreciated that when an inner divider is adjacent to the left outer divider, a channel is formed for a certain container size, for example an eight ounce container. The distance between dividers may be expanded by the use of adaptors or spacers 100, 102 which may be positioned between adjacent dividers 14, 16, 18. The spacers 100, 102 are shown in FIG. 7 in one embodiment. The spacers include a generally longitudinally extending support surface 104 having a width. The spacers include a plurality of connectors 106 (see FIG. 8) similar to connectors 30. The spacers are positioned between adjacent dividers 14, 16 and 18 and increase the width between adjacent walls proportional to the width of the spacer. In one embodiment, two sizes of spacers are anticipated, such as the half inch and one inch length spacers 100, 102 shown in FIG. 7.

Figure 9:
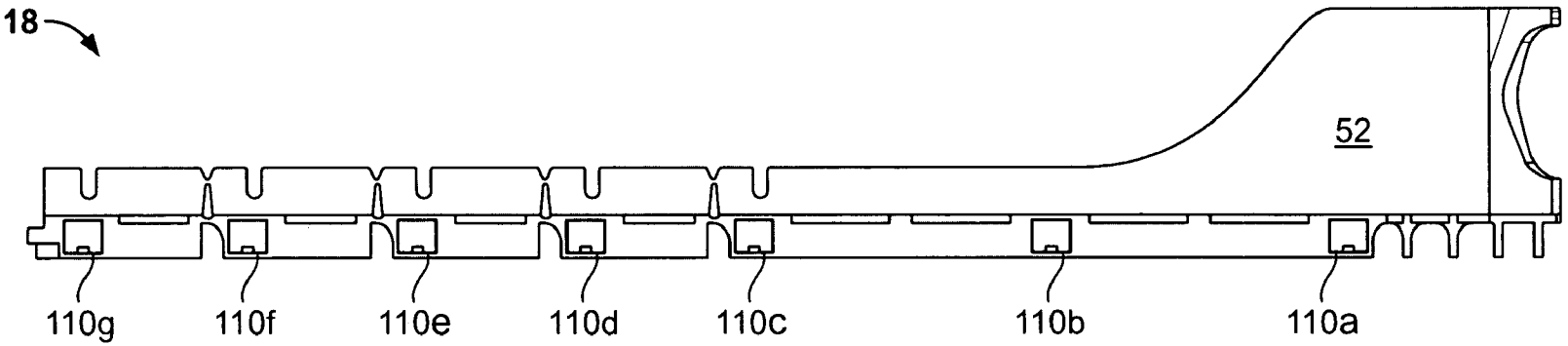
FIG. 9 is a side elevational view of the left outer divider in accordance with the present invention.
Figure 10:
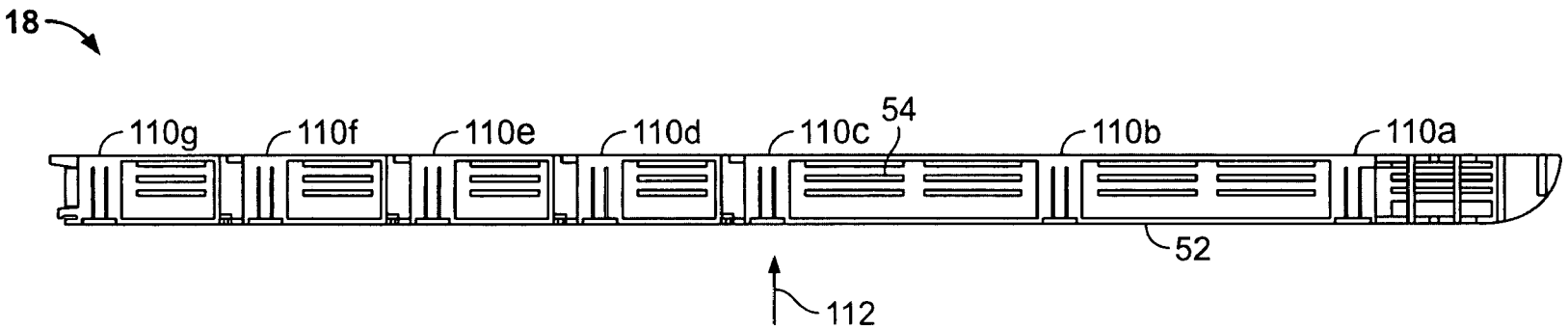
FIG. 10 is a bottom plan view of the left outer divider of FIG. 9.

The left outer divider in an embodiment of the present invention is indicated in general at 18 in FIGS. 9 and 10. As described previously with regard to FIG. 2, the left outer divider 18 includes a longitudinally extending wall 52 with a left merchandise support 54 extending from the wall 52. The left outer divider also features a number of connectors indicated at 110*a*-110*g*.

Figure 11:
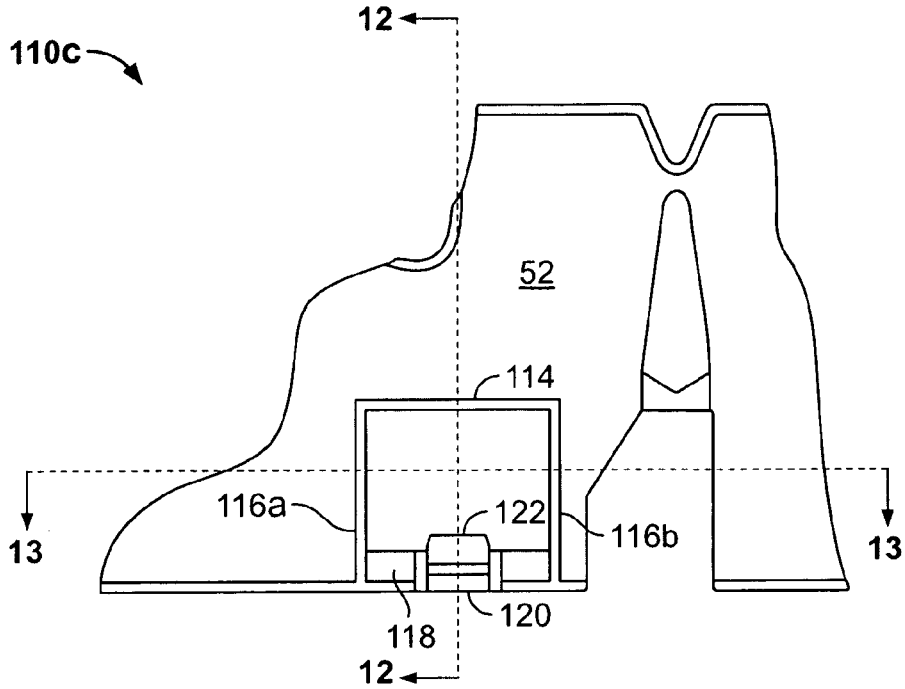
FIG. 11 is an enlarged side view of one of the connectors of the left outer divider of FIG. 9.

An enlarged view of connector 110*c* of FIGS. 9 and 10, taken from the direction illustrated by arrow 112 of FIG. 10, is illustrated in FIG. 11. Alternative views of the connector 110*c* are presented in FIGS. 12 and 13. While the details of connector 110*c* are described below, it should be understood that connectors 110*a*, 110*b* and 110*d*-*g* feature the same construction.

Figure 12:
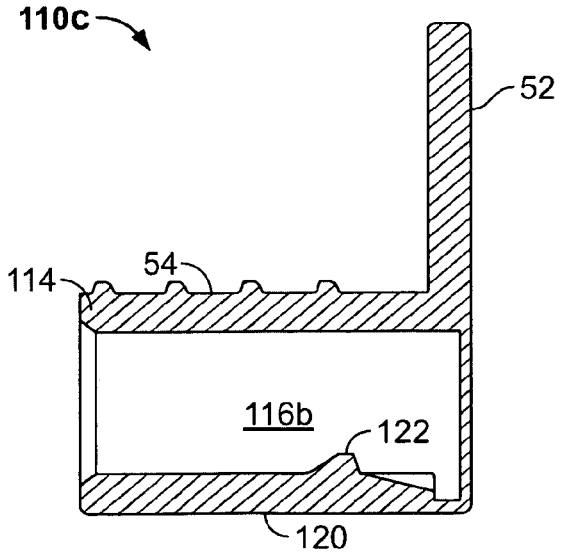
FIG. 12 is a sectional view of the connector of FIG. 11 taken along line 12-12.
Figure 13:
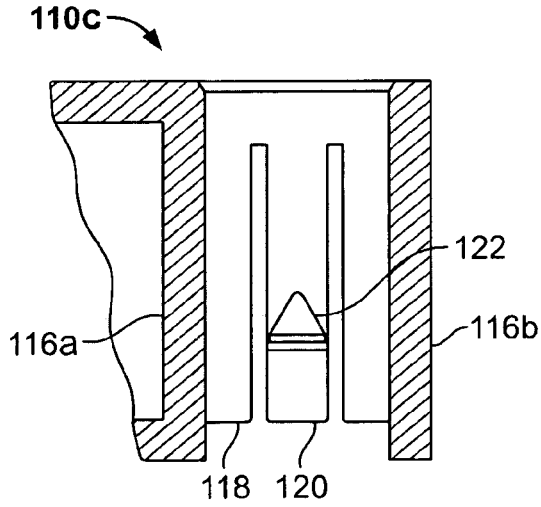
FIG. 13 is sectional view of the connector of FIG. 11 taken along line 13-13.

As illustrated in FIGS. 11-13, similar to the connectors 60 of FIGS. 5, 6A and 6B, the connector 110*c* includes a top wall 114, opposing sidewalls 116*a* and 116*b* and a bottom wall 118. The connector 110*c*, however, does not feature an end wall such as the one illustrated at 74 in FIGS. 6A and 6B for connector 60. As illustrated in FIGS. 11-13, the bottom wall 118 of connector 110*c* includes a finger 120, having a locking projection 122.

Figure 14:
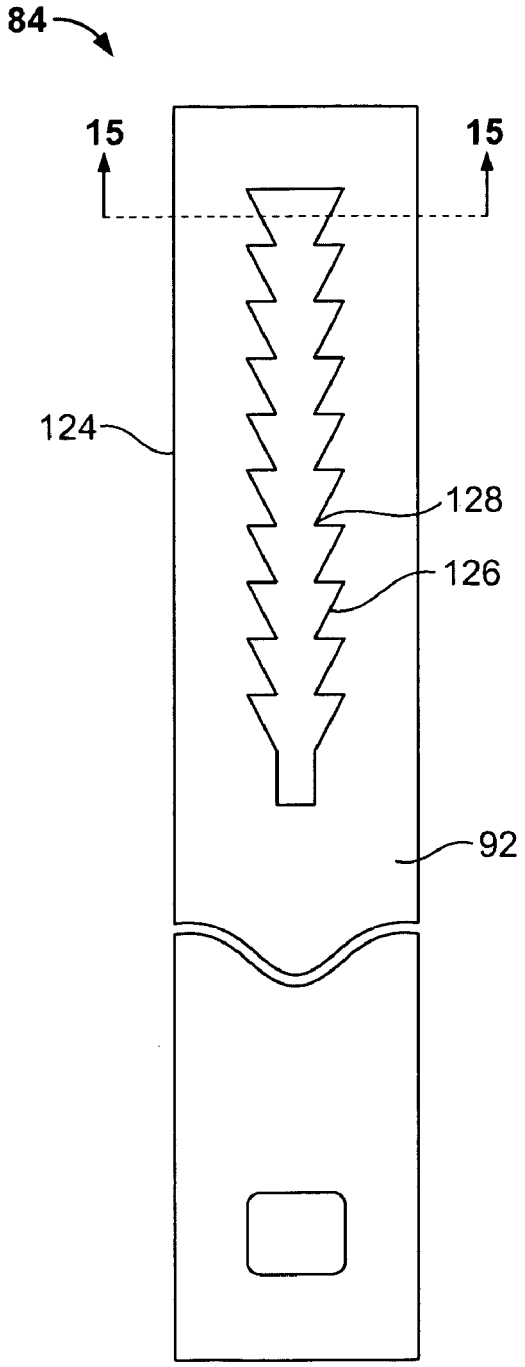
FIG. 14 is a top plan view of a portion of one of the rods suitable for use with the left outer divider and connector of FIGS. 9-13 in accordance with the present invention.
Figure 15:
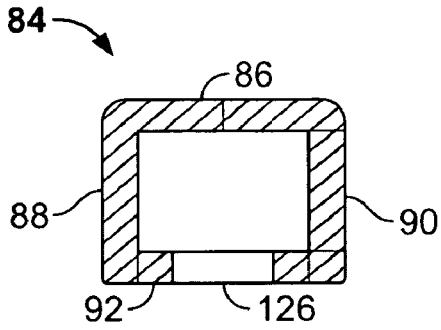
FIG. 15 is a sectional view of the rod of FIG. 14 taken along line 15-15.

The details of the left end portion 124 of one of the rods 84 suitable for use with the left outer divider and connector of FIGS. 9-13 is illustrated in FIGS. 14 and 15. More specifically, as described previously with regard to FIG. 4, the rod 84 includes four walls 86, 88, 90 and 92. The bottom wall 92 includes an adjustable latch slot 126. As illustrated in FIG. 14, the slot is constructed from teeth 128 that define a series of adjacent semi-triangular shaped openings where each opening is sized and shaped to receive the locking projection 122 of the connector 110*c* of FIGS. 11-13.

Figure 16A:
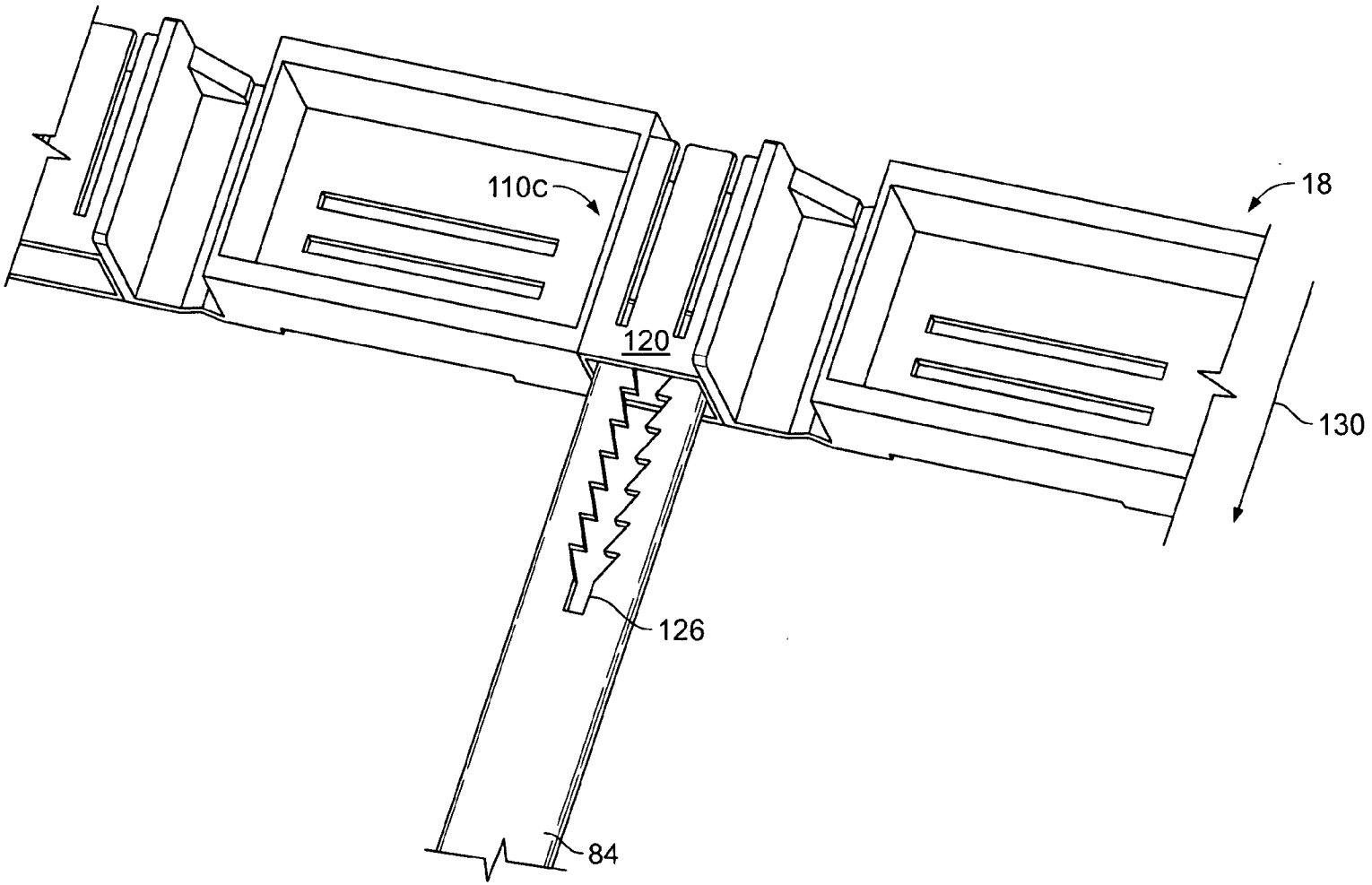
FIGS. 16A and 16B are partial bottom perspective views of a left end of a rod extending through the connector of the left outer divider with the left outer divider in first and second positions on the rod, respectively.
Figure 16B:
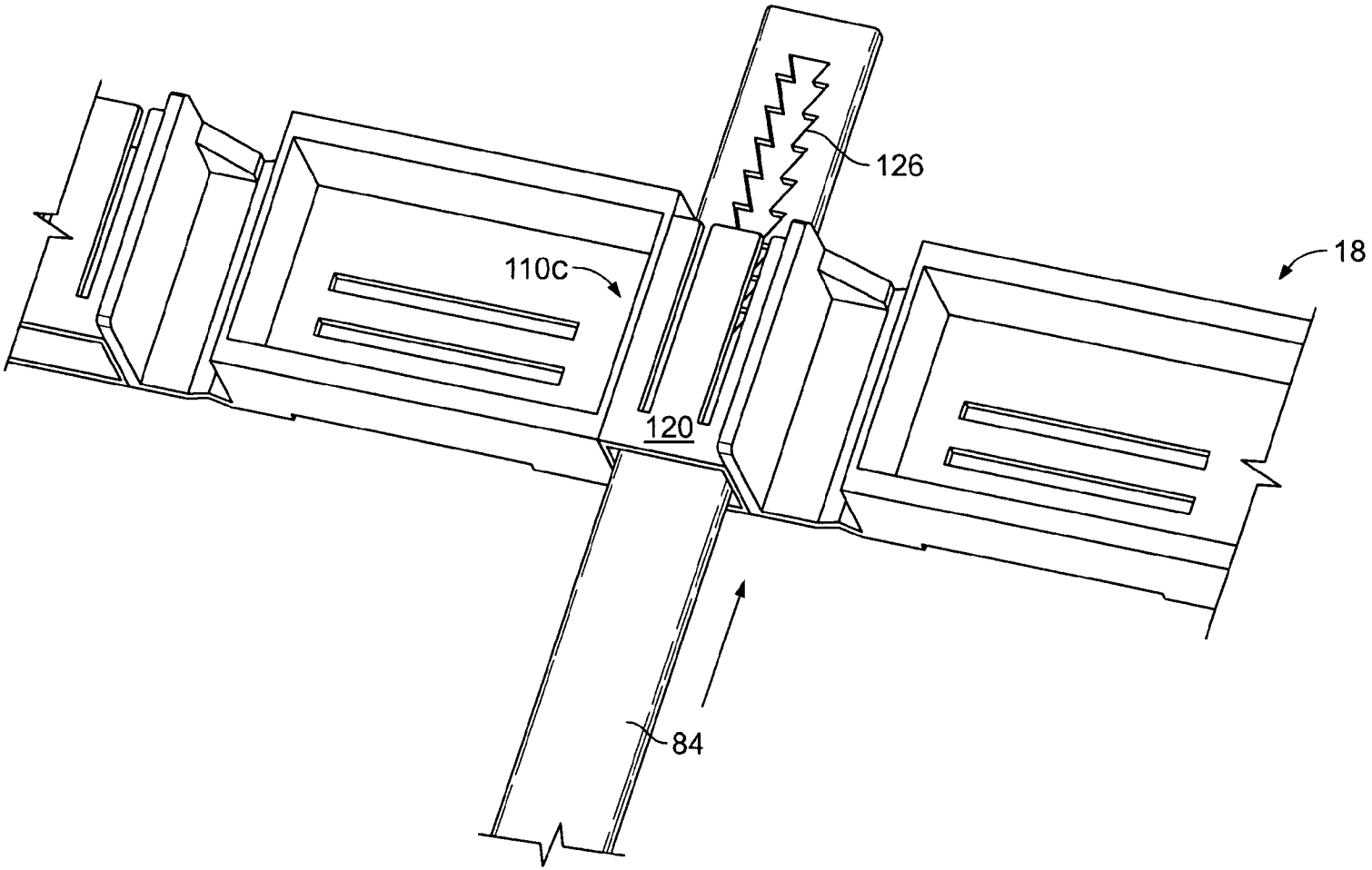

FIGS. 16A and 16B show the left end of rod 84 extending through the connector 110*c* of the left outer divider 18. The rod 84 slides freely within the connector 110*c* when the locking projection (122 in FIGS. 11-13) on the finger 120 of the connector 110*c* is not engaging one of the openings of adjustable latch slot 126 (FIGS. 14 and 15). Other rods 84 engage the other connectors 110*a*, 110*b* and 110*d*-110*g* (of FIGS. 9 and 10) in the fashion indicated for connector 110*c* in FIGS. 16A and 16B.

As illustrated in FIG. 16A for connector 110*c*, left outer divider 18 is initially installed on the left ends of the rods 84 so that locking projections of the connectors (110*a*-110*g*) engage the semi-triangular openings at the distal ends of the rod adjustable latch slots (126 in FIG. 14). The left outer divider 18 may be adjusted inwards by movement in the direction indicated by arrow 130 in FIG. 16A. As the left outer divider, and thus connector 110*c*, travels in the direction of arrow 130, the locking projection of the connector (122 of FIGS. 11-13), due to its triangular shape, forces the teeth 128 (FIG. 14) of the adjustable latch slot to slightly compress so that the locking projector may travel between the semi-triangular openings of adjustable latch slot. As a result, the left outer divider travels in the direction of arrow 130 of FIG. 16A in a ratcheting fashion. The left outer divider thus may be slid to a desired position on rods 84, as indicated in FIG. 16B for connector 110*c*.

It is to be understood that while the embodiment of the invention described above features a non-adjustable right outer divider 16 and an adjustable left outer divider 18, the side of the adjustable outer divider could be reversed or both outer dividers could be adjustable in the manner described above for left outer divider 18.

It will be appreciated that the retail business will be capable of assembling a shelving system using the described component parts, to provide plurality of channels, wherein each channel may be of the same size or of an assortment of sizes, to accommodate various sized merchandise.

While the preferred embodiments of the invention have been shown and described, it will be apparent to those skilled in the art that changes and modifications may be made therein without departing from the spirit of the invention, the scope of which is defined by the appended claims.

What is claimed is:

1. A gravity feed display rack for supporting and displaying merchandise, comprising:

a merchandise channel support structure including a rod, said rod having an adjustable latch slot formed therein;

an inner divider slidably mounted on the rod of the merchandise channel support structure, said inner divider including a merchandise support and a longitudinally extending wall; and an outer divider including a merchandise support, a longitudinally extending wall and a connector, said connector having at least one wall defining an interior passage sized to receive the rod of the merchandise channel support structure so that said outer divider travels along said rod as said rod slides within the passage of said connector and having a flexible finger formed in said at least one wall and featuring a distal end portion upon which a locking projection is positioned, said locking projection sized to engage the adjustable latch slot of the rod under the urging of the flexible finger so that the outer divider may be slid to and secured in a desired position on the rod of the merchandise channel support structure.

2. The rack of claim 1 wherein the adjustable latch slot is formed in an end portion of the rod of the merchandise channel support structure.

3. The rack of claim 1 wherein the adjustable latch slot features a plurality of teeth.

4. The rack of claim 3 wherein the teeth define a plurality of adjacent, semi-triangular openings in the adjustable latch slot and the locking projection of the connector is generally triangular shaped so as to selectively engage the semi-triangular openings of the adjustable latch slot in a ratcheting fashion as the connector is slid along the rod.

5. The rack of claim 1 wherein said connector and said rod each include a top wall, opposing side walls and a bottom wall and wherein said adjustable latch slot is formed in a downward facing surface of the bottom wall of the rod and said flexible finger is formed in the bottom wall of the connector.

* * * * *